United States Patent [19]

Fukishima et al.

[11] Patent Number: 4,681,393

[45] Date of Patent: Jul. 21, 1987

[54] ELECTRICAL CONNECTOR ASSEMBLY

[75] Inventors: Minoru Fukishima, Yokohama; Shinsuke Kunishi, Yamato, both of Japan

[73] Assignee: Molex Incorporated, Lisle, Ill.

[21] Appl. No.: 773,952

[22] Filed: Sep. 9, 1985

[30] Foreign Application Priority Data

Oct. 11, 1984 [JP] Japan ..... 59-213235

[51] Int. Cl.[4] ..... H01R 13/11

[52] U.S. Cl. ..... 439/851

[58] Field of Search ..... 339/258 R, 258 RR, 278 T, 339/252 R, 256 R, 256 C, 256 RT, 256 S, 256 SP, 256 T, 258 A, 258 C, 258 F, 258 P, 258 S, 258 T, 258 TC, 259 R, 259 F

[56] References Cited

U.S. PATENT DOCUMENTS

| | | | |
|---|---|---|---|
| 2,907,976 | 10/1959 | Damon | 339/258 R |
| 2,955,178 | 10/1960 | Lander et al. | 339/256 C |
| 3,370,265 | 2/1968 | Berg | 339/256 R |
| 3,406,376 | 10/1968 | Varrin | 339/258 R |
| 3,783,440 | 1/1974 | Karube et al. | 339/258 RR |
| 3,894,785 | 7/1975 | Hubner et al. | 339/258 R |
| 3,998,518 | 12/1976 | Mathe | 339/217 S |
| 4,015,891 | 4/1977 | Pemberton | 339/217 S |
| 4,076,369 | 2/1978 | Ostapovitch | 339/258 R |
| 4,493,527 | 1/1985 | Piscitelli et al. | 339/258 R |

*Primary Examiner*—Gil Weidenfeld
*Assistant Examiner*—Gary F. Paumen
*Attorney, Agent, or Firm*—Louis A. Hecht

[57] ABSTRACT

An electrical connector assembly includes an elongated, electrically conductive female terminal formed from metal wherein the female terminal comprises a front end shaped to receive, in electrical connection therewith, a male terminal, said front end including a plurality of walls defining a male terminal-receiving opening, including a first wall portion defining a first slit therein and a second wall portion defining a second slit therein, said slits extending toward a rear end of the female terminal to provide resiliency to said wall portions for expansion of said opening when a male terminal is received in said male terminal-receiving opening. The first slit extends a greater distance toward the rear end than the second slit so that the first wall portion has a greater resiliency than the second wall portion. The male terminal includes a front end cooperatively shaped to fit within the male terminal-receiving opening of the female terminal and has opposed walls shaped for relatively high pressure electrical contact against the lateral projections of said female terminal.

13 Claims, 15 Drawing Figures

ELECTRICAL CONNECTOR ASSEMBLY

FIELD OF THE INVENTION

The present invention is directed to an electrical connector assembly including male and female terminals electrically connected through relatively high pressure contact projections laterally extending from a resilient female terminal for electrical connection using a relatively small insertion force.

BACKGROUND OF THE INVENTION AND PRIOR ART

Various male-female electrical connector constructions have been devised in an attempt to provide both high pressure contact pressure between the male and female terminals and low insertion force. For the most part, such connectors have failed to provide both features simultaneously. The present invention provides for excellent, high pressure electrical contact while providing resilient terminals for low pressure insertion force.

The following prior art patents disclose various features which may be considered material in considering the patentability of the claimed invention. Terminals disclosing retaining dimples or elongated flutes are disclosed in Berg U.S. Pat. No. 3,370,265 and Varrim U.S. Pat. No. 3,406,376. Female contacts have inwardly extending contact bights are found in the following patents: Wilm U.S. Pat. No. 3,426,320; Ostapovitch U.S. Pat. No. 4,076,369; and Paoli U.S. Pat. No. 4,128,293. Retaining lances to hold a box terminal within a housing are disclosed in Pemberton U.S. Pat. No. 4,015,891 and Bennett et al. U.S. Pat. No. 4,342,495. A female terminal having a stop shoulder to prevent overinsertion of a contact is disclosed in Mathe U.S. Pat. No. 3,998,518.

SUMMARY OF THE INVENTION

The present invention is directed to new and improved male and female electrical terminals shaped to interconnect to establish electrical connection therebetween and a new and improved electrical connector assembly including the electrical terminals connected together. The invention is also directed to the electrical terminals each mounted within an insulative housing such that the housings telescopically interconnect to establish electrical connection between the terminals.

In brief, the electrical connector assembly includes an elongated, electrically conductive female terminal formed from metal wherein the female terminal comprises a front end shaped to receive, in electrical connection therewith, a male terminal, said front end including a plurality of walls defining a male terminal-receiving opening, including a first wall portion defining a first slit therein and a second wall portion defining a second slit therein, said slits extending toward a rear end of the female terminal to provide resiliency to said wall portions for expansion of said opening when a male terminal is received in said male terminal-receiving opening. The first slit extends a greater distance toward the rear end than the second slit so that the first wall portion has a greater resiliency than the second wall portion. The female terminal includes opposed wall portions each having one or more lateral inward projections extending within the male terminal-receiving opening for electrical connection to the male terminal. The lateral projections extend inwardly to a greater extent at a location nearer the first slit than at a location nearer the second slit to compensate for the greater resiliency in the first wall portion to achieve substantially uniform electrical contact pressure at symmetrical contact area portions of opposed projections. The rear end of the female terminal is adapted for electrical connection to another circuit element and an intermediate portion of the female terminal electrically connects the front end to the rear end. The male terminal includes a front end cooperatively shaped to fit within the male terminal-receiving opening of the female terminal and has opposed walls shaped for relatively high pressure electrical contact against the lateral projections of said female terminal.

The female terminal is formed from flat metal having longitudinal end walls and the flat metal is formed or bent to dispose the end walls in close proximity to each other, thereby forming the first slit defined by a seam or gap between the longitudinal end walls and to form the male terminal-receiving opening at the front end of the female terminal. In accordance with one important feature of the present invention, the second slit or gap of the female terminal is disposed in vertical or horizontal alignment with the first slit or gap to achieve a symmetrical flexing action of the resilient walls of the female terminal.

To achieve the full advantage of the present invention, the lateral inward projections in the female terminal are centrally disposed on opposed inner wall portions of the female terminal and formed such that opposed male terminal contact portions nearest the first slit are disposed 2–10%, preferably 3–6%, closer to each other than opposed male terminal-contact portions farthest from the first slit.

In accordance with another important feature of the present invention, the male terminal includes a tapered front end for easier insertion into the female terminal, including female contact wall portions bent toward each other in a V-shape at the front end of the male terminal. To prevent the male terminal from interference by the inner female terminal walls during insertion, the front end of the male terminal includes a plow wall curved upwardly from a lower front end wall of the male terminal.

In accordance with another important embodiment of the present invention, the electrical connector assembly includes a female, electrically conductive terminal disposed within a first insulative housing and a male, electrically conductive terminal disposed within a second insulative housing, the first insulative housing having a mating portion surrounding a male terminal-receiving opening in a front end of the female terminal and the second insulative housing having a mating portion surrounding a front end of the male terminal. The front end of the male terminal is adapted to be received within the male terminal-receiving opening of the female terminal and the first and second insulative housings are shaped such that one of the insulative housings is telescopically received within the other insulative housing for electrical connection of the male terminal within the female terminal.

In accordance with the present invention, the female terminal includes a first wall portion defining a first slit therein and a second wall portion defining a second slit therein, the slits extending toward a rear end of the female terminal to provide resiliency to the slit wall portions for expansion of the female opening when a male terminal is received therein. The first slit extends a greater distance toward the rear end than the second slit so that the first wall portion has a greater resiliency than the second wall portion. The female terminal includes opposed wall portions each having one or more lateral inward projections extending within the male terminal-receiving opening for electrical connection to the male terminal. The lateral projections extend inwardly to a greater extent at a location nearer the first slit than at a location nearer the second slit to compensate for the greater resiliency in the first wall portion to achieve substantially uniform electrical contact pressure at symmetrical contact area portions of opposed projections.

In accordance with another important feature of the present invention, the male terminal is generally U-shaped and adapted to fit within the female terminal such that the base of the U is adjacent the second slit and the legs of the U are in contact with the laterally extending projections of the female terminal.

In accordance with still another important feature of the present invention, the male and female terminals are shaped cooperatively to an inner shape of the male and female insulative housings to lock the terminals in proper position within the housings. The female terminal includes a plurality of spring biased locking lances cooperatively shaped to lock against locking surfaces on the interior surface of the first insulative housing adapted to lock the locking lances thereagainst when the female terminal is inserted a sufficient distance into the first housing. The female terminal also includes a pair of stop tabs extending upwardly from a rear portion of the male terminal-receiving cavity to limit the amount of penetration possible by the female terminal into the first insulative housing. The first insulative housing includes a pair of inner surface stop shoulders for contact against the stop tabs when the female terminal is inserted sufficiently to lock the locking lances against the first housing inner locking surfaces.

To achieve the full advantage of the present invention, the female terminal further includes a plurality of alignment dimples extending into the male terminal-receiving cavity of the female terminal to maintain alignment between the male terminal and the female terminal.

Similarly, the male terminal includes a plurality of spring biased locking lances and its insulative housing (the second housing) includes inner locking surfaces defining shoulders thereon adapted to lock the male terminal locking lances thereagainst when the male terminal is inserted a sufficient distance into the second housing. The male terminal includes a pair of laterally extending stop tabs and, like the first housing, the second housing includes a pair of inner stop surfaces for contact against the male stop tabs when the male terminal is inserted sufficiently to lock the male locking lances against the second housing inner locking surfaces.

Accordingly, an object of the present invention is to provide a new and improved female electrical terminal;

Another object of the present invention is to provide a new and improved male electrical terminal;

Another object of the present invention is to provide a new and improved electrical connector including new and improved male and female electrical connectors adapted to interconnect to establish electrical connection between circuit elements;

Still another object of the present invention is to provide a new and improved connector assembly;

A further object of the present invention is to provide a new and improved electrial connector assembly including new and improved male and female terminals capable of achieving electrical connection through high pressure contact projections using a relatively small insertion force.

Another object of the present invention is to provide a new and improved connector assembly including a resilient female terminal having a plurality of inwardly extending lateral projections for contact against a male terminal wherein opposed contact portions of the projections are differently spaced to compensate for differences in resiliency in different portions of the male or female terminal;

These and other objects and advantages of the present invention will become apparent with reference to the following detailed description.

DETAILED DESCRIPTION OF THE PREFERRED EMBODIMENTS

Figure 1:
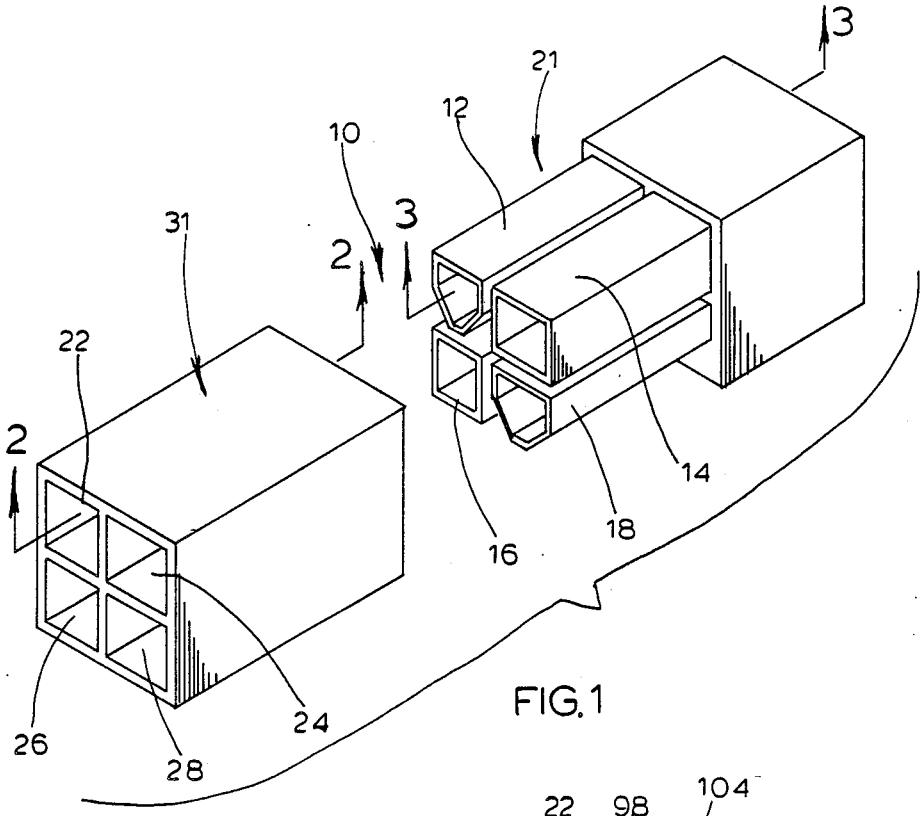
FIG. 1 is a perspective view of the electrical connector assembly of the present invention showing a plurality of male terminals and a plurality of female terminals disposed within insulative housings.

Turning now to the drawings, and initially to FIG. 1, there is illustrated a new and improved electrical connector assembly, constructed in accordance with the principles of the present invention, generally designated by reference numeral 10. The electrical connector assembly 10 generally includes one or more insulative housings 12, 14, 16, and 18, surrounding one or more electrically conductive female terminals 20 forming one or more female terminal assemblies generally designated 21; and one or more insulative housings 22, 24, 26, and 28 surrounding one or more male terminals 30 forming one or more male terminal assemblies generally designated 31. In accordance with a preferred embodiment, as shown in FIG. 1, the housings 12, 14, 16 and 18 surrounding the female terminals 20 are keyed or shaped so that the housings 12, 14, 16 and 18 can be telescopically joined with the housings 22, 24, 26, and 28 surrounding the male terminals 30 only in one-way (as shown in FIG. 1) to prevent electrical connection between incorrect male and female terminals.

Figure 4:
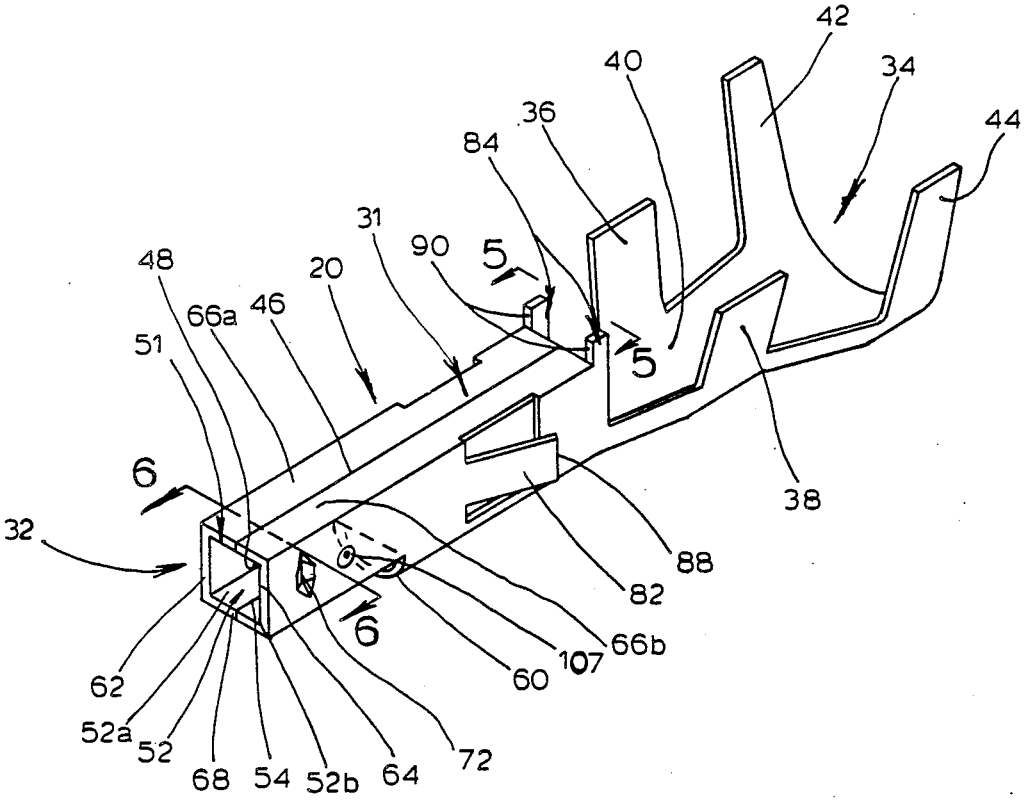
FIG. 4 is a perspective view of the female terminal constructed in accordance with the principles of the present invention.

The female terminal 20, best shown in FIG. 4, is cut and formed or bent from a flat sheet of metal stock, and in accordance with the embodiment shown in FIG. 4, is formed to provide a male terminal-receiving front end, generally designated 32, in a generally rectangular shape. The female terminal 20 also includes a rear end, generally designated 34, including a pair of electrically conductive bendable tabs 36 and 38 surrounding a wire receiving lower channel 40 adapted to be bent or clinched over a bare wire or other circuit element disposed within the wire receiving channel 40. The rear end 34 of the female terminal 20 also includes a second pair of bendable tabs 42 and 44 adapted to be bent or clinched onto an insulated portion 45 of the wire in channel 40 to provide a stress relief for the wire as well known in the art.

In accordance with an important feature of the present invention, the female terminal 20 is bent or formed from flat metal having longitudinal end walls formed or bent to dispose the end walls in close proximity to form a first seam or slit 46 defined by the adjacent end walls (FIG. 4). The seam or slit 46 extends from a terminal-receiving opening 48 defined by the formed metal at the terminal-receiving front end 32 of the female terminal 20 completely across a terminal-receiving resilient, conductive housing or enclosure, generally designated 31 and, by virtue of the forming operation from flat metal, extends completely through an upper wall, generally designated 51, of the terminal-receiving housing 31.

In accordance with another important feature of the present invention, an opposite or lower wall portion, generally designated 52, of the terminal-receiving housing 31 also includes a seam or slit 54 aligned with the seam or slit 46.

In accordance with another important feature of the present invention, the terminal receiving housing 31 comprises a reduced cross-sectional area portion 56 (FIG. 5) at the front end 32 and an enlarged cross-sectional area portion 58 having a rounded lower wall 60 extending from and integral with a rearward portion of side walls 62 and 64. The upper, longer slit or seam 46 and the lower, shorter seam or slit 54 provide some resiliency to upper and lower walls 66 and 68, respectively (FIG. 6), so that less insertion force is necessary to mate the male terminal 30 within the female terminal 20, while providing high pressure electrical contact as will be described in more detail hereinafter.

Figure 6:
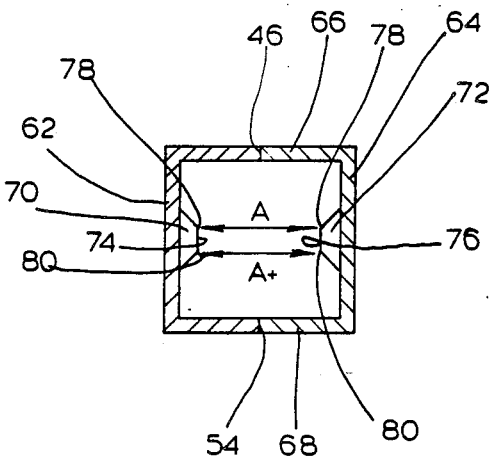
FIG. 6 is a transverse cross-sectional view of the female terminal of FIG. 5 taken through the line 6—6 of FIG. 4.

In accordance with another important feature of the present invention, opposed walls 62 and 64 are formed to provide inwardly extending lateral projections 70 and 72, respectively, for electrical contact against the male terminal 30. As shown in the embodiment of FIG. 6, the formed, laterally extending projections 70 and 72 each include an elongated male terminal-contact surface 74 and 76, respectively, each slightly angled from vertical. As indicated by the distances A+ and A shown in FIG. 6, the elongated contact surfaces 74 and 76 extending inwardly from sidewalls 62 and 64 are centrally aligned within the female terminal cavity such that an uppermost male terminal contact surface portion 78 (closest to the longer slit 46) of each projection 70 and 72 are spaced a shorter distance than the lowermost male terminal contact surface portion 80 (closest to shorter slit or seam 54) of each inwardly extending lateral projection 70 and 72. The uppermost contact surface portions 78 of the projections 70 and 72 are closer together than the lowermost contact surface portion 80 since the terminal-receiving housing 31 is more resilient at the upper wall 51 than at the lower wall 52. When the male terminal 30 is inserted into the female terminal 20, the upper wall 51 will spread apart at seam 46 more easily than lower wall 52 will spread at seam 54. The shorter distance between contact surface portions 78 than between contact surface portions 80 will equalize the contact forces against the male terminal 30, after insertion at surface portions 78 and 80. In this manner, the contact forces exerted on the male terminal 30 at each point of contact over the length of the elongated surface portions 74 and 76 will be essentially equal when examined in the same horizontal plane at a point of contact on each elongated contact surface 74 and 76.

The distance between the two uppermost male terminal contact surface portions 78 is about 2% to about 10% shorter than the distance between the lowermost male terminal contact surface portions 80 so that the pressure of the uppermost contact surface portion 78 and the lowermost contact surface portions 80 against the male terminal 30 will be approximately the same. The uppermost male terminal contact surface portions 78 are closer together than the lowermost male terminal contact surface portions 80 to take into account the greater resiliency of the upper portion of the female terminal 20 because of the greater dimension of the seam or slit 46 extending completely across the upper wall 66 defining an upper portion of the male terminal receiving cavity 31. Further, the male terminal 30 is more resilient toward an uppermost portion of the contacting side walls since the male terminal 30 does not have an upper structural wall. The difference in dimensions between the uppermost contact surface portions 78 and the lowermost contact surface portions 80 can be varied depending upon the thickness of the female terminal walls 62, 64, 66, and 68; the difference in the length of upper and lower slits 46 and 54; and the outer dimensions of the male terminal 30 with respect to the inner dimensions of the male terminalreceiving cavity 31 of the female terminal 20.

Figure 7:
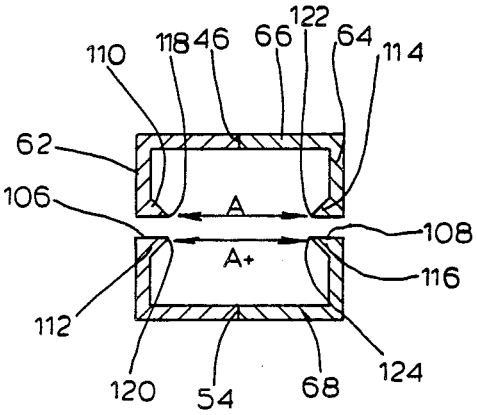
FIGS. 7 and 8 are front views similar to FIG. 6 showing alternate embodiments for the construction of the male terminal-receiving cavity portion of the female terminal.
Figure 8:
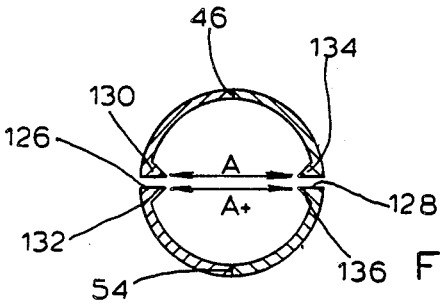

As shown in FIGS. 7 and 8, the female terminal 20 can have varied cross sectional shapes while providing contact force equalizing lateral projections.

Figure 5:
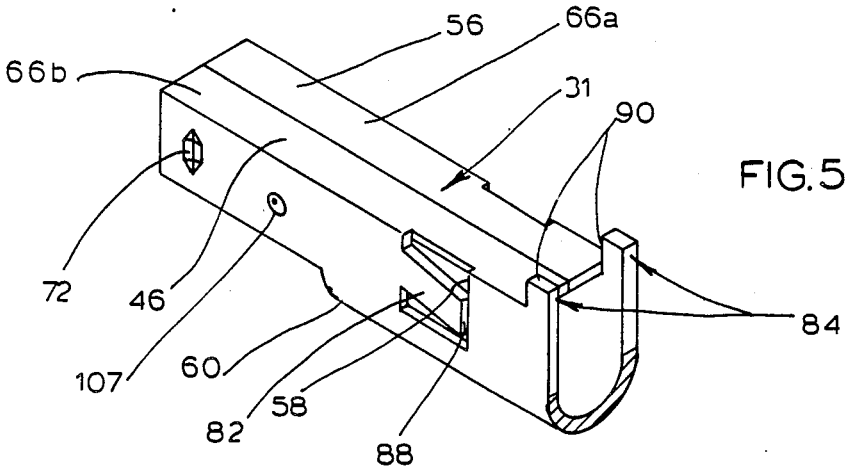
FIG. 5 is a partially broken away, elevational and cross-sectional view of the female terminal of FIG. 4 looking in the direction of arrows 5—5 and showing the male terminal-receiving cavity.

The seam or slit 54 in the lower wall 68 extends from the front end 32 of the female terminal 20 toward the rear end 34 of the female terminal 20 but does not extend completely across the male terminal receiving cavity 31. As best shown in FIGS. 4 and 5, the female terminal 20 is formed or bent from flat metal to provide the lower wall 68 extending from the front end 32 about $\frac{1}{3}$ to $\frac{1}{2}$ of the distance of the length of the male terminal receiving cavity 31. At this point, the lower wall 68 is formed to be integral with the curved or rounded lower wall 60 to form a larger or enlarged cross sectional area rearward portion of the male terminal receiving cavity 31 of the female terminal 20. The curved or rounded lower wall 60 is formed integral with the sidewalls 62 and 64 of the female terminal and acts as a spring to resiliently bias upper wall halves 66*a* and 66*b* together and to bias lower wall half portions 52*a* and 52*b* together and permits the upper wall halves 66*a* and 66*b* to be separated, slightly arcuately, when the male terminal 30 is forced into the female terminal 20 against the spring bias provided by the curved or rounded lower wall 60 to equalize the forces against the male terminal 30 by the uppermost and lowermost male terminal contact surface portion 78 and 80 of the lateral projections 70 and 72.

Figure 3:
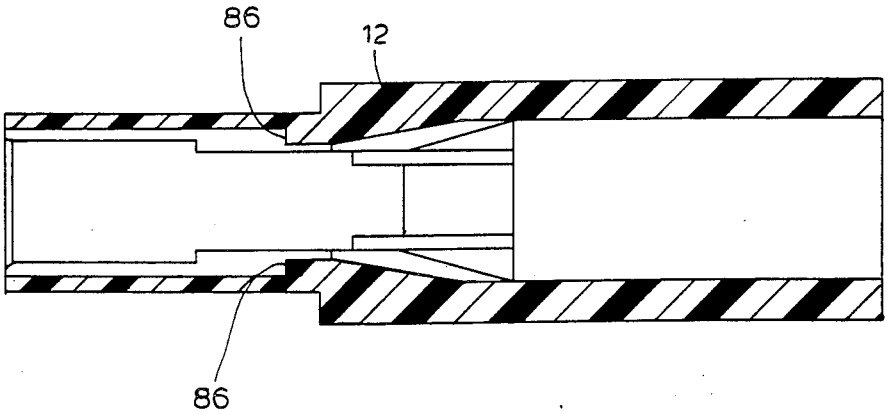
FIG. 3 is a cross-sectional, side view of a female terminal portion of the electrical connector assembly of FIG. 1 taken through the line 3—3 of FIG. 1.
Figure 13:
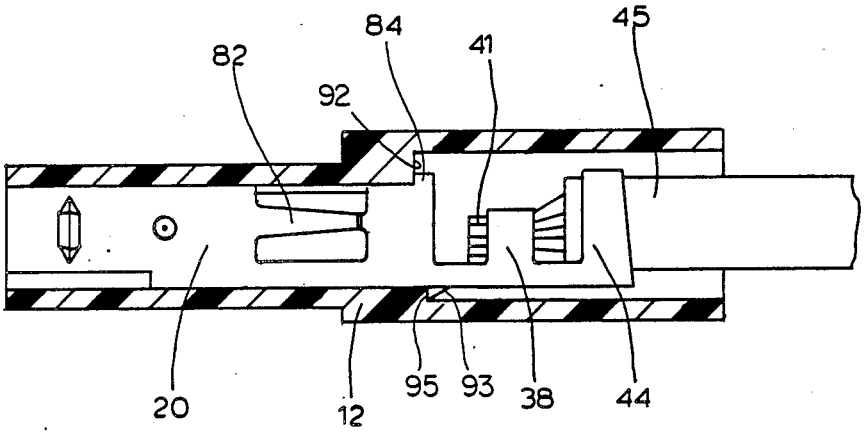
FIG. 13 is a longitudinally extending, side view of the female terminal of FIG. 4, to form a female terminal assembly.
Figure 14:
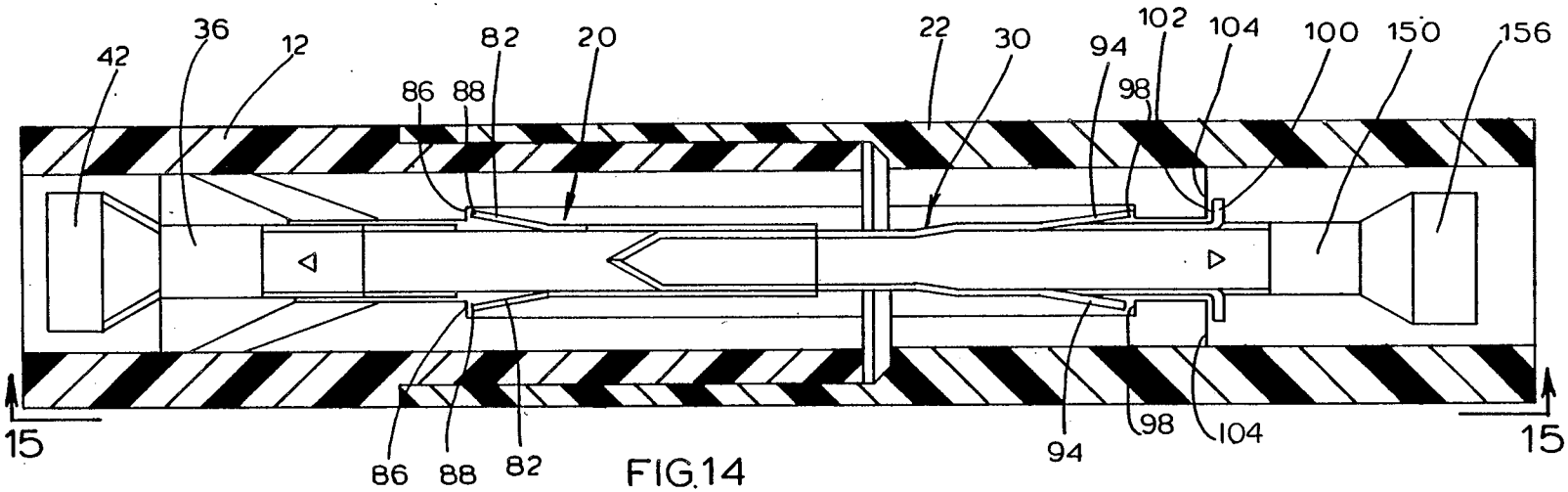
FIGS. 14 and 15 are longitudinally extending cross-sectional, top and side views, respectively, of the electrical connector assembly of the present invention including the terminal assemblies of FIGS. 12 and 13 mechanically and electrically connected together.
Figure 15:
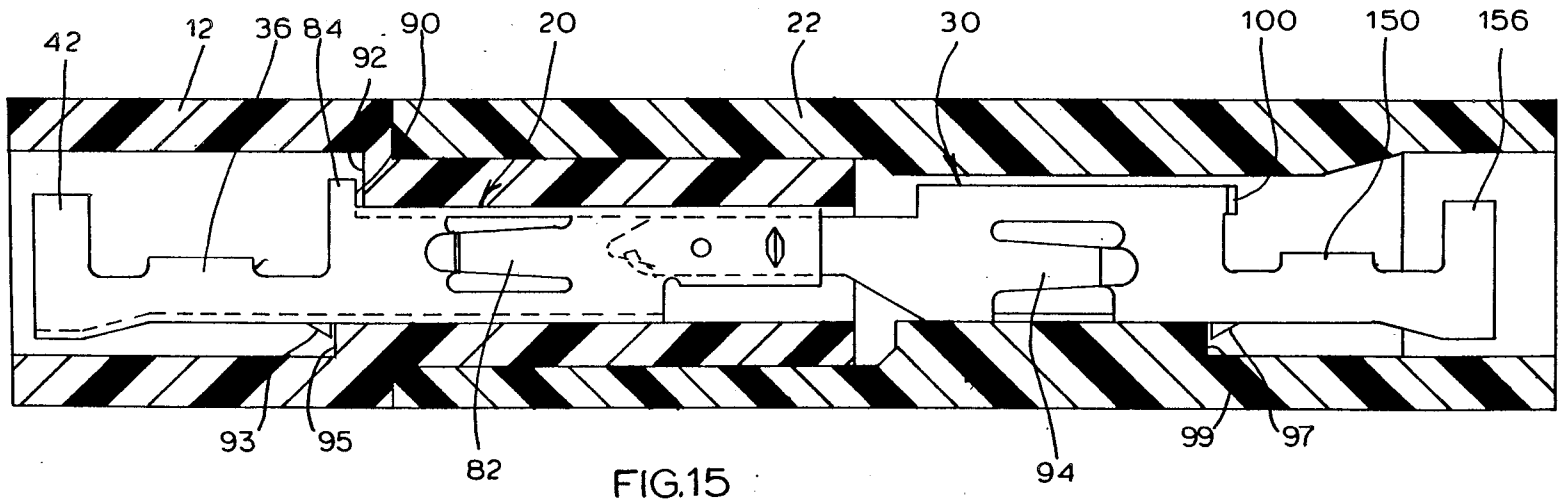

In accordance with another important feature of the present invention, as best shown in FIGS. 4, 13 and 14, the female terminal 20 is formed to include locking spring tabs or lances 82 extending outwardly from sidewalls 62 and 64 of the female terminal 20 and a pair of rigid stop tabs 84 extending upwardly from the top wall 66 of the female terminal 20 for locking the female terminal 20 in a proper position within the insulative housing 12. The female terminal 20 is inserted into the housing 12 from right toward left as shown in FIG. 3 so that the spring tabs or lances 82 are slightly compressed when the female terminal 20 is received within the housing 12 as the lances 82 pass an inner shoulder 86 (FIG. 3). As the locking lances 82 pass the shoulder 86 they expand outwardly to rest against the inner housing shoulder 86. The longitudinal distance between end surfaces 88 on the locking lances 82 and the stop surfaces 90 on the upwardly extending stop tabs 84 enables the stop surfaces 90 to be positioned against inner shoulders 92 on the interior of the female housing 12 at the same time that the end surfaces 88 of the locking lances 82 are expanded outwardly to rest against the shoulders 86 on the interior of the housing 12 and bottom stopper 93 engages shoulder 95 to lock the female terminal in position within the housing 12 (FIGS. 13 and 15).

Figure 2:
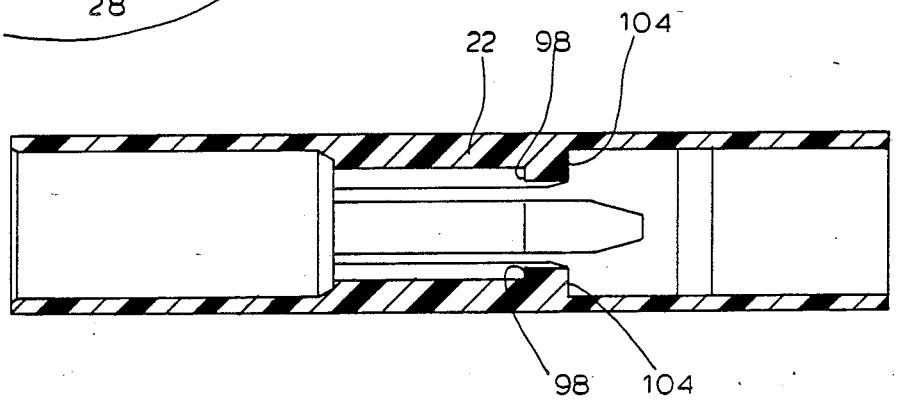
FIG. 2 is a cross-sectional, side view of a male terminal portion of the electrical connector assembly of FIG. 1 taken through the line 2—2 of FIG. 1.
Figure 12:
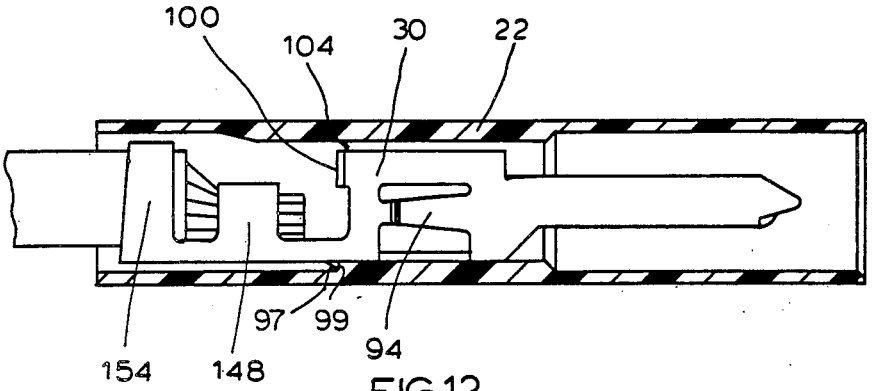
FIG. 12 is a longitudinally extending, side view of the male terminal of FIG. 9, shown as positioned within an insulative housing to form a male terminal assembly.

Similarly, the male terminal 30 includes locking spring tabs or lances 94 having end surfaces 96 spring biased to fall behind and lock against shoulders 98 in the male terminal housing 22 and laterally extending stop tabs 100 having stop surfaces 102 locking against shoulders 104 (FIG. 2) on the interior of the male terminal receiving housing 22. Bottom stop 97 engages shoulder 99 to retain terminal 30 in housing 22 (FIGS. 12 and 15).

In accordance with another important feature of the present invention, the female terminal 20 includes one or more alignment dimples 107 in longitudinal alignment with the laterally extending projections 70 or 72 in the sidewalls 62 and 64 and spaced therefrom to maintain alignment of the male terminal 30 within the female terminal 20 so that the male terminal 30 does not fit closer to either sidewall 62 or 64 but is maintained in central longitudinal alignment within the female terminal 20.

As shown in FIG. 7, the female terminal 20, at the front end 32, can be formed having slits 106 and 108 in sidewalls 62 and 64 extending toward the rear end 34 of the female terminal and ending at the laterally extending projections. In this manner, two distinct and sharply pointed laterally extending projections 110 and 112 are formed in sidewall 62 and two distinct, sharply pointed laterally extending projections 114 and 116 are formed in sidewall 64 to provide high pressure contact of the points 118, 120, 122 and 124 against the male terminal 30. Similar to the construction shown in FIG. 6, the points 118 and 122 are spaced a smaller distance than the points 120 and 124 to provide equalization of contact forces of all four points 118, 120, 122 and 124 against the male terminal 30 since the slit 46 in the upper wall 66 extends completely longitudinally across the upper wall 66 forming a portion of the male terminal receiving cavity and the lower slit or seam 54 extends only partially across the lower wall 52 forming a portion of the male terminal receiving cavity 31.

Turning now to FIG. 8, another embodiment is shown for the female terminal 20 cross-sectional shape in the form of a continuous, curved or tubular structure, for example, in the shape of an ellipse. In the tubular shape, lateral projections can be formed in the sides of the ellipse in alignment across the widest diameter of the ellipse either in the shape of the bar type projections, described with reference to numerals 70 and 72 in FIG. 6, or in the form of the sharply pointed multiple projections as described with reference to reference numerals 118, 120, 122 and 124 in FIG. 7. As shown in FIG. 8, the widest dimension of the ellipse is formed having side slots 126 and 128 forming two sharply pointed laterally extending projections 130 and 132 along one side of the ellipse and two sharply pointed laterally extending projections 134 and 136 in an opposite side of the ellipse such that projections 130 and 134 are in horizontal alignment and projections 132 and 136 are in horizontal alignment. The distance between projections 130 and 134 is less than the distance between projections 132 and 136 to compensate for the greater resiliency at the top of the ellipse than at the bottom of the ellipse because of the difference in the lengths of the slits 46 and 54.

Figure 9:
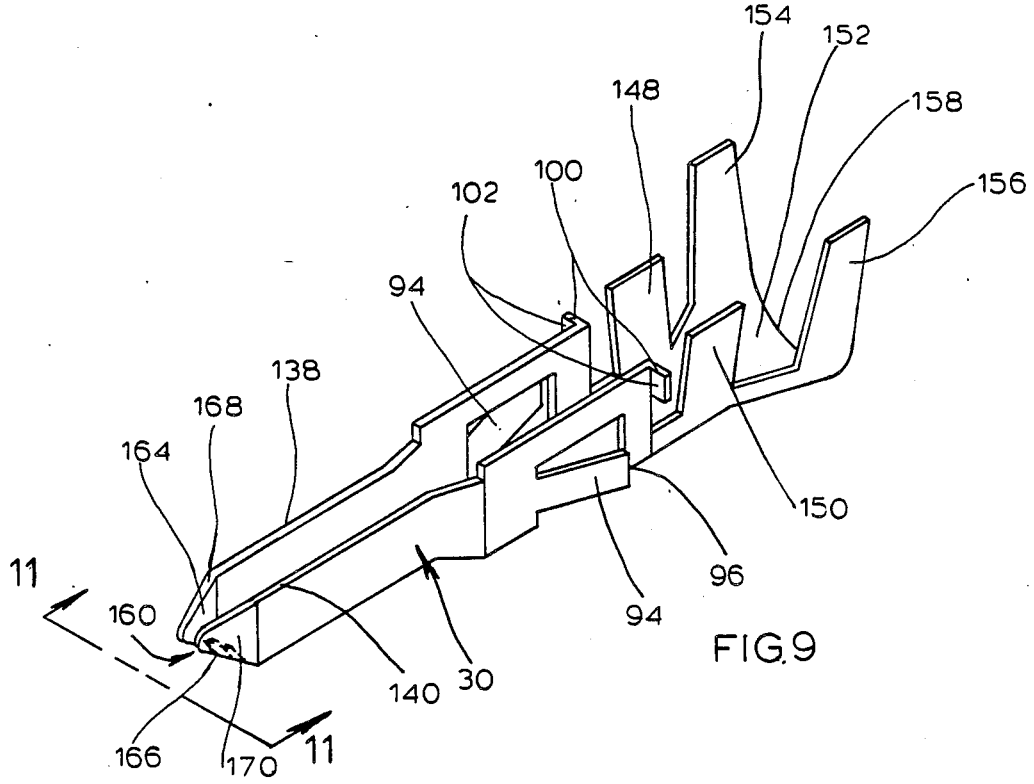
FIG. 9 is a perspective view of the male terminal constructed in accordance with the principles of the present invention.
Figure 10:
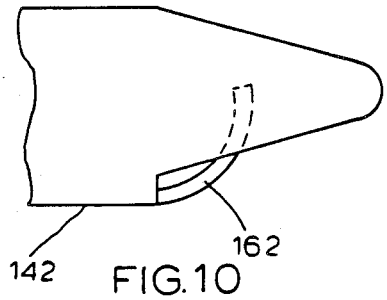
FIG. 10 is a partially broken away, side view of the male terminal of FIG. 9 showing the front or nose portion of the male terminal.
Figure 11:
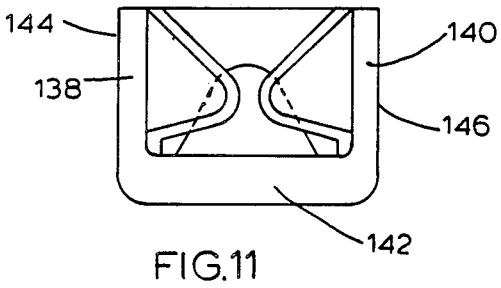
FIG. 11 is a front view of the male terminal of FIG. 9 taken through the line 11—11 of FIG. 9.

Turning now to FIGS. 9–11, the male terminal 30, like the female terminal 20, is formed from flat metal stock including two upwardly turned sidewalls 138 and 140 integral with a lower or bottom wall 142 to form a generally U-shaped male terminal dimensioned to fit within the cavity 31 of the female terminal 20. The sidewalls 138 and 140 include outer surfaces 144 and 146, respectively, for electrical connection to the inwardly extending lateral projections 70 and 72 in the female terminal 20. Like the female terminal 20, the male terminal 30 includes electrically conductive bendable tabs 148 and 150 for bending or clinching against a bare wire inserted within a wire receiving lower channel 152 and a second pair of bendable tabs 154 and 156 at a rear end 158 of the male terminal 30 to be bent or clinched around an insulated portion of the wire resting within the wire receiving lower channel 152 to act as a stress relief to prevent the disengagement of the wire from the electrically conductive clinched tabs 148 and 150.

In accordance with another feature of the present invention, a front end 160 of the male terminal 30 is formed in a V-shaped wedge by bending the sidewalls 138 and 140 at the front end 160 toward each other to form a generally V-shaped front or insertion end 160 of the male terminal 30. Further, the lower wall 142 is bent to curve upwardly in a smooth arc to form a lower plow member 162 (FIG. 10) so that the lower surface 142 of the male terminal does not have any sharp edges which might make more difficult the insertion of the male terminal 30 into the female terminal 20. In accordance with this construction of the insertion end 160 of the male terminal 30, electrical connection between the male terminal 30 and the female terminal 20 can be made with relatively low insertion forces while providing a relatively high pressure electrical contact between the male terminal 30 and the female terminal 20 due to the sharp contacts and resilient terminals.

The front end 160 of the male terminal 30 includes two curved, converging nose sections 164 and 166 integral with the sidewalls 138 and 140 bent toward each other and each shaped as a longitudinal section of a truncated cone with the smallest diameter cone section nearest the front end 160 of the male terminal 30. In this manner, the nose sections 164 and 166 and the plow member 162, in combination forming the front end 160 of the male terminal 30, can be easily inserted within the terminal receiving cavity 31 of the female terminal 20 without interference from minor inner surface imperfections of the female terminal walls 62, 64, 66 and 68. Further, the nose sections 164 and 166 provide sloped external surfaces 168 and 170 for initial contact against the lateral extending projections 70 and 72 within the female terminal 20 to minimize the force necessary to insert the male terminal 30 within the female terminal 20 to establish electrical connection therebetween.

We claim:

1. An electrical connector assembly including a female terminal having a body with a mating end and a circuit-connecting end, the body defining a terminal-receiving opening in said mating end and a terminal-receiving passageway inwardly extending from said opening, and a male terminal telescopically receivable in said terminal-receiving passageway to electrically engage said body of said female terminal, the improvement comprising:

said body of said female terminal including an elongated generally hollow sleeve defining said passageway, with first and second spaced-apart longitudinally extending opposed slits forming first and second laterally opposed pivotally moveable sidewalls having normally abutting edges immediately adjacent said slits, said first slit extending along the entire length of the sleeve, said second slit extending from the mating end along a portion of the length of the sleeve, and a bight portion adjacent said second slit joining said two sidewalls, said bight portion extending the remaining length of the sleeve and biasing said mating edges in abutting engagement, whereby said sidewalls are adapted to be spread apart at the slits upon exertion of internal forces against the sleeve; and a pair of generally opposed inwardly extending rigid terminal-engaging projections formed on said two sidewalls, each having first and second end portions extending into said terminal receiving passageway and located adjacent said first and second slits, respectively, said first end portions having a closer spacing therebetween than said second end portions to impart a greater spreading displacement to said mating edges adjacent said first slit when said male terminal is inserted between said projections, resulting in substantially uniform electrical contact pressures against said male terminal.

2. The connector assembly of claim 1 wherein said bight portion is laterally positioned to one side of both said first and said second slits.

3. The connector assembly of claim 2 wherein said female terminal is stamped from a unitary metal sheet having opposed edges, said sheet being bent to form a generally U-shaped cross-section comprising said bight portion, and to dispose said edges of said sheet in normally abutting relationship to form said first slit.

4. The connector assembly of claim 1 wherein said projections are formed on said two sidewalls adjacent the mating end of said female terminal in an opposed relationship which minimizes the spacing between said projections.

5. The connector assembly of claim 4 wherein said rigid projections are arranged such that said first and second end portions of one projection generally oppose the first and second end portions of the other projection, respectively, and said first end portions being disposed 2–10% closer to each other than said second end portions.

6. The connector assembly of claim 4 wherein said rigid projections are arranged such that said first and second end portions of one projection generally oppose the first and second portions of the other projection respectively, and said first end portions being disposed 3–6% closer to each other than said second end portions.

7. The connector assembly of claim 4 wherein said female terminal further comprises a pair of generally opposed inwardly extending rigid aligning dimples formed on said two sidewalls to extend into said terminal receiving passageway, said dimples axially displaced to one side of said projections, remote from said mating ends to align said male terminal and said projections.

8. The connector assembly of claim 1 wherein said sleeve comprises a generally hollow cylinder, and said sidewalls each being generally part-circular in cross-section.

9. The connector assembly of claim 8 wherein said first and said second slits are positioned in diametric opposition about said cylinder so that said sidewalls are each generally semicircular in cross-section.

10. The connector assembly of claim 1 wherein said sleeve has a generally rectangular cross-sectional configuration with each sidewall having a generally U-shaped cross section.

11. The connector arrangement of claim 10 wherein the cross-sections of each of said sidewalls are generally mirror images of each other.

12. The connector assembly of claim 10 wherein said male terminal is generally U-shaped in cross section with the legs of the U generally converging toward each other at a leading end of said male terminal to provide camming surfaces during telescopic insertion in said female terminal.

13. The connector assembly of claim 12 wherein said male terminal includes an intermediate wall between said legs of said U-shaped cross-section which is curved to extend between said converging legs to provide a third camming surface during telescopic insertion in said female terminal.

* * * * *